US011545096B2

(12) United States Patent
Kang

(10) Patent No.: US 11,545,096 B2
(45) Date of Patent: Jan. 3, 2023

(54) DRIVING METHOD OF DISPLAY MODULE, DRIVING SYSTEM THEREOF, AND DRIVING DEVICE

(71) Applicant: HKC CORPORATION LIMITED, Shenzhen (CN)

(72) Inventor: Chih Tsung Kang, Chongqing (CN)

(73) Assignee: HKC CORPORATION LIMITED, Shenzhen (CN)

( * ) Notice: Subject to any disclaimer, the term of this patent is extended or adjusted under 35 U.S.C. 154(b) by 81 days.

(21) Appl. No.: 16/982,049

(22) PCT Filed: Mar. 11, 2019

(86) PCT No.: PCT/CN2019/077601
§ 371 (c)(1),
(2) Date: Sep. 18, 2020

(87) PCT Pub. No.: WO2020/118924
PCT Pub. Date: Jun. 18, 2020

(65) Prior Publication Data

US 2021/0020118 A1 Jan. 21, 2021

(30) Foreign Application Priority Data

Dec. 11, 2018 (CN) ..... 201811510612.X
Dec. 11, 2018 (CN) ..... 201811511896.4

(51) Int. Cl.
*G09G 3/34* (2006.01)
*G09G 3/36* (2006.01)
*G09G 5/06* (2006.01)

(52) U.S. Cl.
CPC ..... *G09G 3/3413* (2013.01); *G09G 3/342* (2013.01); *G09G 3/3607* (2013.01); *G09G 5/06* (2013.01);
(Continued)

(58) Field of Classification Search
CPC ..... G09G 3/34–3426; G09G 3/2003
See application file for complete search history.

(56) References Cited

U.S. PATENT DOCUMENTS

2016/0117975 A1* 4/2016 Kang ..... H04N 9/68 345/694
2017/0169751 A1* 6/2017 Ando ..... G09G 5/02
2019/0228720 A1* 7/2019 He ..... G09G 3/36

FOREIGN PATENT DOCUMENTS

CN 101794565 A 8/2010
CN 101887681 A 11/2010
(Continued)

OTHER PUBLICATIONS

Peipei Li, the International Searching Authority written comments, dated Aug. 2019, CN.
(Continued)

*Primary Examiner* — Roy P Rabindranath

(57) ABSTRACT

The present disclosure provides a driving method of a display module, a driving system thereof, and a display device. The driving method of the display module includes a display panel driving process, and a backlight module driving process driven synchronously with the display panel driving process. The display panel driving process includes steps: performing a color saturation adjustment; and obtaining second color signals to drive the display panel by converting. The backlight module driving process includes steps: using the light source adjustment coefficient to adjust a first brightness value to obtain a second brightness value; determining a dominant hue light source; and driving the dominant hue light source by the second brightness value.

19 Claims, 5 Drawing Sheets

(52) U.S. Cl.
CPC ..... *G09G 2320/0242* (2013.01); *G09G 2320/0666* (2013.01); *G09G 2340/06* (2013.01); *G09G 2360/16* (2013.01)

(56) References Cited

FOREIGN PATENT DOCUMENTS

| | | | |
|---|---|---|---|
| CN | 102737610 | A | 10/2012 |
| CN | 103634580 | A | 3/2014 |
| CN | 107146569 | A | 9/2017 |
| CN | 101115211 | A | 1/2018 |
| CN | 107728377 | A | 2/2018 |
| CN | 108010492 | A | 5/2018 |
| CN | 108280813 | A | 7/2018 |
| JP | 5072087 | B2 | 11/2012 |

OTHER PUBLICATIONS

Peipei Li, the International Searching Report, dated Aug. 2019, CN.

* cited by examiner

DRIVING METHOD OF DISPLAY MODULE, DRIVING SYSTEM THEREOF, AND DRIVING DEVICE

CROSS REFERENCE OF RELATED APPLICATIONS

This application claims priority to the Chinese Patent Application No. CN201811510612.X, filed with National Intellectual Property Administration, PRC on Dec. 11, 2018 and entitled "DRIVE NG METHOD OF DISPLAY MODULE, DRIVING DEVICE THEREOF", and claims priority to the Chinese Patent Application No. CN201811511896.4, filed with National Intellectual Property Administration, PRC on Dec. 11, 2018 and entitled "DRIVLNG METHOD OF DISPLAY MODULE, DRIVING SYSTEM THEREOF, AND DISPLAY DEVICE", which are incorporated herein by reference in their entirety.

TECHNICAL FIELD

The present disclosure relates to a field of display panel technology, and in particular to a driving method of a display module, a driving system thereof, and a driving device.

BACKGROUND

It should be understood that the statements herein merely provide background information related to the present disclosure and do not necessarily constitute prior art.

With the development and advancement of technology, liquid crystal displays have become mainstream products of displays because of their thin bodies, low power consumption and low radiation, and have been widely used. Conventional display apparatuses are mostly backlight display apparatuses, which includes a liquid crystal display (LCD) panel and a backlight module. Operating principle of the LCD panel is that liquid crystal (LC) molecules are disposed between two glass substrates, where the two glass substrates are parallelly disposed, and a driver voltage is applied on the two glass substrates to control rotation directions of the LC molecules, so that light of the backlight module are refracted to generate images.

A color deviation of a Large size LCD panel, especially a Vertical Alignment (VA) LCD panel, is severe.

SUMMARY

The present disclosure provides a driving method of a display module, a driving system thereof, and a display device to adjust a intensity of the light sources to improve color saturation and color deviation.

To achieve the above object, the present disclosure provides a driving method of a display module, includes a display panel driving process, and a backlight module driving process driven synchronously with the display panel driving process.

The display module includes a plurality of first color light sources and second color light sources. The first color light sources and the second color light sources are controlled independently.

The display panel driving process includes steps:

receiving first color signals in an RGB (red, green, blue) system corresponding to a display panel; and converting the first color signals into first color space signals in an HSV (hue, saturation, value) system;

adjusting a color saturation of the first color space signals by predetermined adjustment coefficients to obtain second color space signals in the HSV system, and convening the second color space signals into second color signals in the RGB system; and driving the display panel by the second color signals;

The backlight module driving process includes steps:

receiving the first color signals in the RGB system corresponding to the display panel, obtaining the first color space signals in the HSV system and the second color space signals in the HSV system, and obtaining a light source adjustment coefficient according to the first color space signals and the second color space signals;

adjusting a first brightness value corresponding to the first color light sources and/or the second color light sources by the light source adjustment coefficient to obtain a second brightness value;

determining a dominant hue light source from the first color light sources and the second color light sources; and driving the dominant hue light source by the second brightness value.

The present disclosure further provides a driving system of a display module, including a display panel driving circuit, and a backlight module driving circuit driven synchronously with the display panel driving circuit.

The display module includes a plurality of first color light sources and second color light sources. The first color light sources and the second color light sources are controlled independently. The display panel driving circuit includes a receiving circuit, a color saturation adjustment circuit, and a first driving circuit.

The receiving circuit receives first color signals in an RGB system corresponding to a display panel and converts the first color signals into first color space signals in an HSV system. The color saturation adjustment circuit adjusts a color saturation of the first color space signals by predetermined adjustment coefficients to obtain second color space signals in the HSV system, and converts the second color space signals into second color signals in the RGB system. And the first driving circuit drives the display panel by the second color signals.

The backlight module driving circuit includes a light source adjustment calculation circuit, a light source adjustment circuit, a dominant hue light source calculation circuit, and a second driving circuit.

The light source adjustment calculation circuit receives the first color signals in the RGB system corresponding to the display panel, and obtains the first color space signals in the HSV system and the second color space signals in the HSV system, and obtains a light source adjustment coefficient according to the first color space signals and the second color space signals. The light source adjustment circuit adjusts a first brightness value corresponding to the first color light source anchor the second color light source by the light source adjustment coefficient to obtain a second brightness value. The dominant hue light source calculation circuit determines a dominant hue light source from the first color light sources and the second color light sources. And the second driving circuit drives the dominant hue light source by the second brightness value.

The present disclosure further provides a display device including the driving system of the display module.

In the present disclosure, in a technique that is known but not disclosed by the applicant, since in the RGB system, different hues and different color saturation values lead to different color deviations. In order to solve the problem, the first color signals are converted into the first color space signals in the HSV System. And then, the color saturation of the first color space signals is adjusted (in general, to lower the color saturation values) to obtain the second color space signals. Then, the second color space signals are converted into the second color signals to drive the display panel. Thus, the color deviation is well improved. However, since the color saturation values are adjusted, a color saturation of the image is deteriorated. The second brightness value is configured to adjust an intensity of the light sources while adjusting the color saturation, thereby returning the color saturation signal that color saturation is damaged from an unsaturated color point to a saturated hue, which reduces the color deviation, especially reduces a wide viewing angle color deviation. And at the same time, a good color saturation is maintained and a good color performance of solid colors is achieved.

However, only the light source intensity of the dominant hue light source is adjusted. In a color saturation adjustment stage, since the color deviation of solid color hues is more severe, when the color saturation adjustment is performed, color saturation signals of the solid color hues or the signals corresponding to the dominant hue light source adjusted. At a moment, in turn, the dominant hue light source is compensated to compensate a loss of the color saturation due to compensate for an improvement of the color deviation. Thus, a corresponding compensation effect is achieved, the color deviation is improved, the color saturation is improved, a balance of the color deviation and color saturation is achieved, and a display of the display panel is improved.

DETAILED DESCRIPTION

Specific structure and function details disclosed herein are only representative and are used for the purpose of describing exemplary embodiments of the present disclosure. However, the present disclosure may be achieved in many alternative forms and shall not be interpreted to be only limited to the embodiments described herein.

In a large-size liquid crystal display panel, especially in a Vertical Alignment (VA) type liquid crystal display panel, the corresponding wide viewing angle brightness is rapidly saturated with a voltage, resulting in a sharp contrast and a color deviation of image quality from a wide viewing angle compared to the image quality from a front view.

Figure 1:
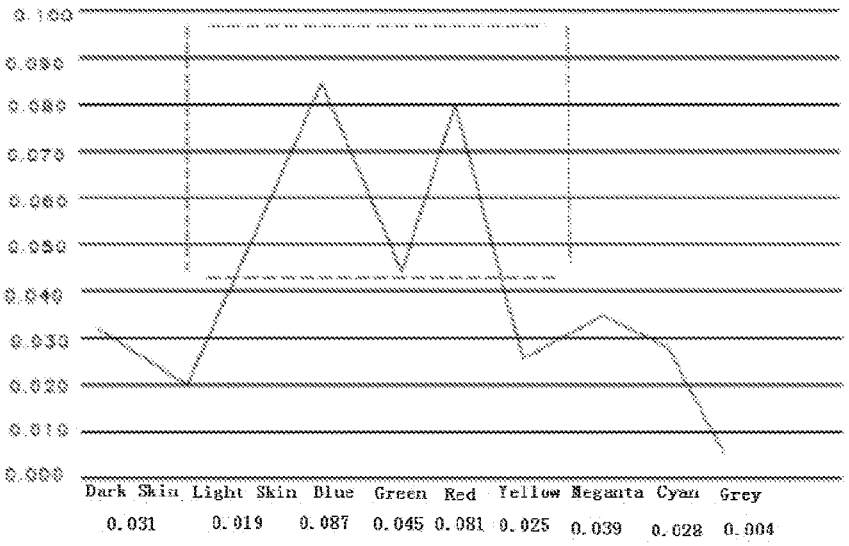
FIG. 1 is a schematic diagram of color deviation variations of a wide viewing angle and a front viewing angle of various representative color systems of a liquid crystal display.

FIG. 1 is a schematic diagram of color deviation variations of a wide viewing angle and a front viewing angle of various representative color systems of a liquid crystal display. As shown in FIG. 1, the ordinate indicates a degree of a color deviation, and it is obvious that the color deviation of R, G, and B hue is more severe than that of other colors.

An exemplary solution is to divide the RGB (Red, Green, Blue) sub-pixels into main pixels/sub-pixels, so that an overall brightness viewed from wide viewing angle approaches the brightness viewed from a front viewing angle along with a variation of the voltage.

Figure 2:
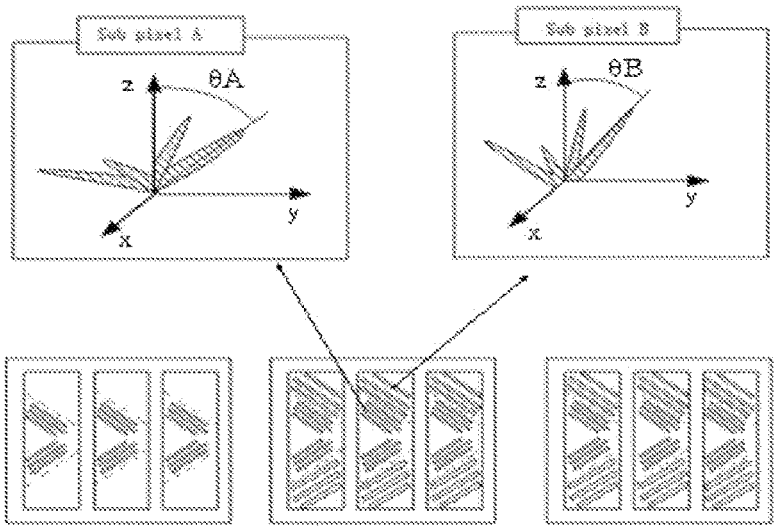
FIG. 2 is a first schematic diagram of dividing an original pixel into main pixels/sub-pixels in an exemplary scheme.
Figure 3:
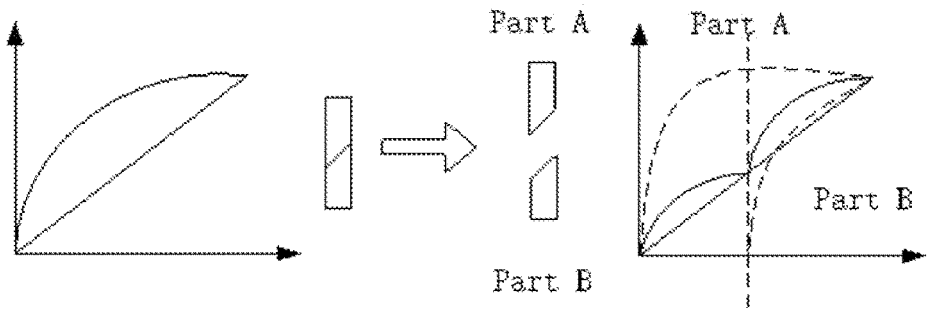
FIG. 3 is a second schematic diagram of dividing an original pixel into main pixels/sub-pixels in an exemplary scheme.

FIG. 2 is a first comparison diagram of distinguishing between original pixels and distinguishing main pixels and sub-pixels. FIG. 3 is a second comparison diagram of distinguishing between original pixels and distinguishing main pixels and sub-pixels. As shown in FIG. 2 and FIG. 3, the x coordinate, the y coordinate, and the z coordinate represent three directions of three-dimensional space respectively. The θA represents a pretilt angle of the main pixels at a large voltage, and θB represents a pretilt angle of the sub-pixels at a small voltage. The abscissa in FIG. 3 is a gray-scale signal, and the ordinate in FIG. 3 is a luminance signal. At a wide viewing angle, the brightness is rapidly saturated with the signal, leading to a large view color deviation (FIG. 3, the arc segment on the left side). Dividing the pixels into main pixels and the sub-pixels is able to improve the phenomenon of color deviation to some extent. To be specific, the original signals are divided into main pixels and sub-pixels with large voltage and small voltage. The large voltage and the small voltage on the front view are configured to make original front signals to change along with a brightness variation. Part A of FIG. 3 shows that the brightness in the large voltage viewing from side changes along with the grayscales. Part B of FIG. 3 shows that the brightness in the small voltage viewing from side changes along with the grayscale. In this way, the brightness of the side view synthesis changes with the grayscale as the are in the left side, which is closer to the line in the right side, which indicates the brightness viewing from the front viewing angle along with the grayscale. Thus, the brightness viewing from the side view approaches the brightness viewing from the front view, and the color deviation caused by viewing from different angles is improved. The defect is solved by applying different driving voltages on the main pixels and sub-pixels in space. However, it is need to re-design metal wires or thin film transistor (TFT) elements to drive the sub-pixels, which sacrifices a light-transmissive opening region, affects a panel penetration rate, and directly improves costs of the backlight.

Thus, the present disclosure provides a solution based on an improvement of different technical concepts, of which is as follows.

The present disclosure will be further described below in conjunction with the accompanying drawings and embodiments.

Figure 4:
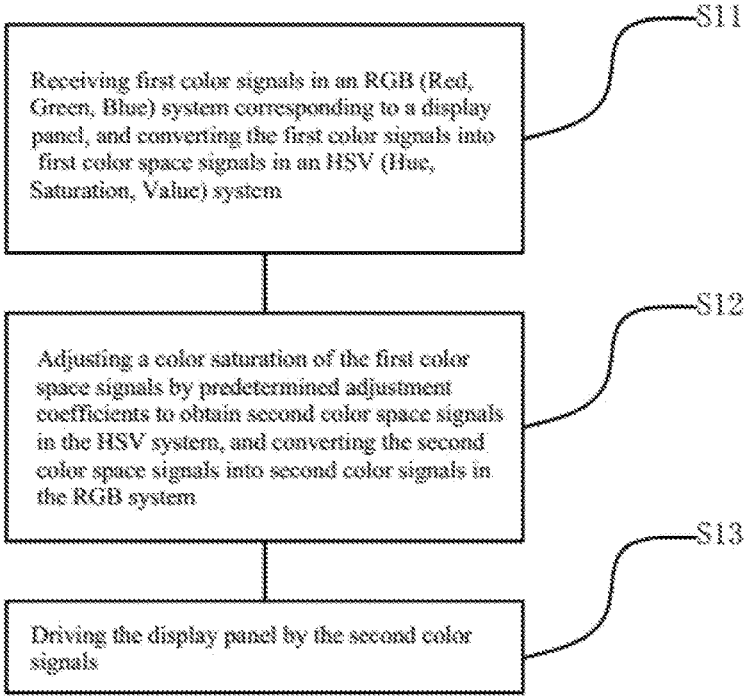
FIG. 4 is a flowchart of a display panel driving process according to one embodiment of the present disclosure.
Figure 5:
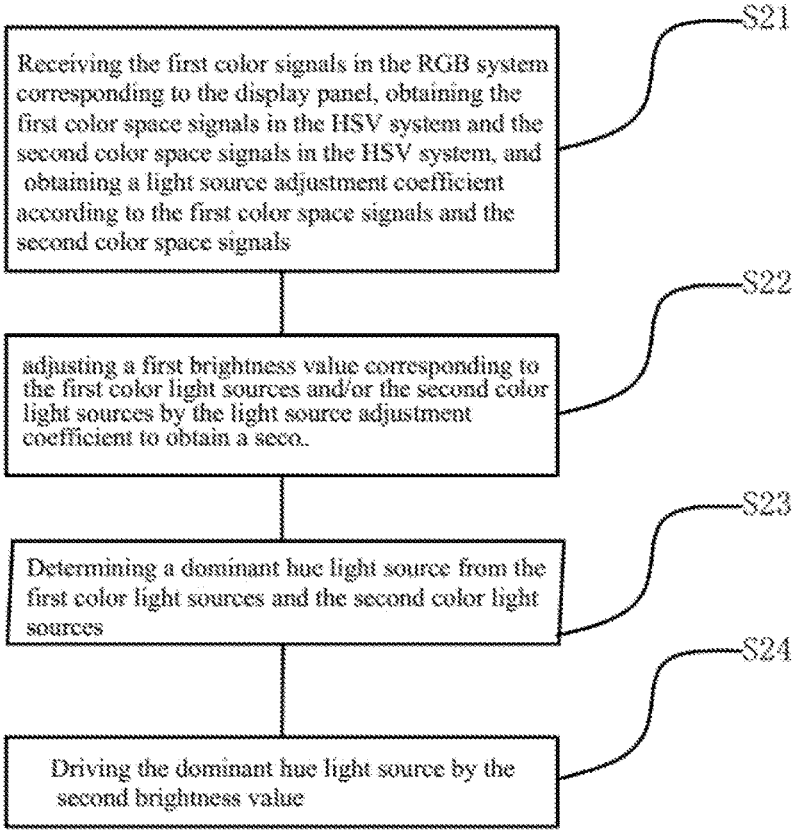
FIG. 5 is a flowchart of a backlight module driving process according to one embodiment of the present disclosure.

FIG. 4 is a flowchart of a display panel driving process according to one embodiment of the present disclosure. FIG. 5 is a flowchart of a backlight module driving process according to one embodiment of the present disclosure. As shown in FIGS. 4 and 5, the present disclosure provides a driving method of a display module, includes a display panel driving process, and a backlight module driving process driven synchronously with the display panel driving process. The display module includes a plurality of first color light sources and second color light sources. The first color light sources and the second color light sources are controlled independently.

The display panel driving process includes steps:

S11: receiving first color signals in an RGB (Red, Green, Blue) system corresponding to a display panel, and converting the first color, signals into first color space signals in an HSV (Hue, Saturation, Value) system;

S12: adjusting a color saturation of the first color space signals by predetermined adjustment coefficients to obtain second color space signals in the HSV system, and converting the second color space signals into second color signals in the RGB system; and S13: driving the display panel by the second color signals.

The backlight module driving process includes steps:

S21: receiving the first color signals in the RGB system corresponding to the display panel, obtaining the first color space signals in the HSV system and the second color space signals in the HSV system, and obtaining a light source adjustment coefficient according to the first color space signals and the second color space signals;

S22: adjusting a first brightness value corresponding to the first color light sources and/or the second color light sources by the light source adjustment coefficient to obtain a second brightness value;

S23: determining a dominant hue light source from the first color light sources and the second color light sources; and S24: driving the dominant hue light source by the second brightness value.

The driving system on which the driving method is applied is disposed at a front end of the display panel, specially disposed in a timing control chip of the display panel. The timing control chip further stores parameters such as the predetermined adjustment coefficient look up table related to the performance of the display panel corresponding to the driving system. In the present disclosure, in a technique that is known but not disclosed by the applicant, since in the RGB system, different hues and different color saturation values lead to different color deviations. In order to solve the problem, the first color signals are converted into first color space signals in the HSV system. And then, the color saturation of the first color space signals is adjusted (in general, to lower the color saturation values) to obtain the second color space signals. Then, the second color space signals are converted into the second color signals to drive the display panel. Thus, the color deviation is well improved. However, since the color saturation value is adjusted, a color saturation of the image is deteriorated; The second brightness value is configured to adjust an intensity of the light source while adjusting the color saturation, thereby returning the color saturation signal that color saturation is damaged from an unsaturated color point to a saturated hue, which reduces the color deviation, especially reduces a wide viewing angle color deviation. And at the same time, a good color saturation is maintained and a good color performance of solid colors is achieved. However, only the light source intensity of the dominant hue light source is adjusted. In a color saturation adjustment stage, since the color deviation of the solid color hues is more severe, when the color saturation adjustment is performed, color saturation signals of the solid color hues or the signals corresponding to the dominant hue light source are adjusted. At a moment, in turn, the dominant hue light source is compensated to compensate a loss of the color saturation due to compensate for an improvement of the color deviation. Thus, a corresponding compensation effect is achieved, the color deviation is improved, the color saturation is improved, a balance of the color deviation and color saturation is achieved, and display of the display panel is improved.

Figure 6:
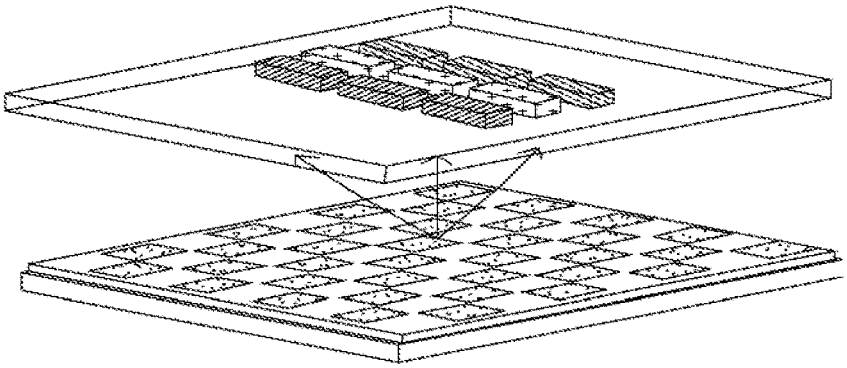
FIG. 6 is a schematic diagram of a direct-lit display module of the present disclosure.

FIG. 6 is a schematic diagram of a direct-lit display module of the present disclosure. As shown in FIG. 6, and further combined with FIGS. 4 and 5, in one embodiment, the display module is a direct-lit backlight display module. The direct-lit backlight display module includes a plurality of backlight partitions. Each of the backlight partitions includes the plurality of the first color light sources and the second color light sources. Each of the backlight partitions further includes a plurality of third color light sources, and the third color light sources are controlled independently.

The step of determining the dominant hue light source includes:

determining the dominant hue light source from the first color light sources, the second color light sources, and the third color light sources.

The backlight partitions may include three light sources controlled independently as shown in FIG. 6, and may adapt to other structures. In the embodiment, the display panel is the direct-lit display panel, which is able to compensate for the loss of color saturation by adjusting the intensity of the light sources. To be specific, each of the backlight partitions includes the plurality of the first color light sources controlled independently, the second color light sources controlled independently, and the third color light sources controlled independently. The color saturation signals of the color space are related to each of light sources. According to the calculation, it is determined that increasing the intensity of the light source of one or several light sources is helpful for the complementary of the color saturation, and then correspondingly adjusting, thereby improving the color deviation, and maintaining good solid color performance of colors.

In one embodiment, the step of obtaining the light source adjustment coefficient according to the first color space signals and the second color space signals includes steps:

obtaining the first color space signals and the second color space signals of all pixels in current backlight partitions corresponding to a current frame, calculating a first average color saturation signal corresponding to the first color space signals and a second average color saturation signal corresponding to the second color space signals respectively; and obtaining the light source adjustment coefficient by calculating the first average color saturation signal and the second average color saturation signal.

To obtain the light source adjustment coefficient according to the first color space signals and the second color space signals, in the embodiment, the intensity of the light sources is adjusted in units of one backlight partition. First, comparing a difference between the color saturation of the first color signals and the second color signals before a color saturation adjustment operation and the color saturation of the first color signals and the second color signals after the color saturation adjustment operation by measuring the first average color saturation signal Sn_ave corresponding to the first color space signals, and the second average color saturation signal S'n_ave corresponding to the second color space signals. Then, based on the difference, the light source adjustment coefficient is calculated, so that the backlight partitions of the display panel improve the color deviation, and the backlight partitions are regarded as one, and each of the backlight partitions separately compensates the color saturation to maintain a good solid color performance of colors.

In one embodiment, the calculation of the light source adjustment coefficient is as follows:

The first color signals are RGB three primary color signals in the RGB system, and the first color signals includes red sub-pixel signals, green sub-pixel signals, and blue sub-pixel signals.

The step of obtaining the light source adjustment coefficient according to the first color signals and the second color signals includes steps:

obtaining the first color signals of all pixels in the current backlight partitions corresponding to the current frame, calculating a maximum average signal of the first color signals maxn_ave and a minimum average signal of the first color signals minn_ave among a red sub-pixel average signal of the first color signals, a green sub-pixel average signal of the first color signals, and a blue sub-pixel average signal of the first color signals; and obtaining the first average color saturation signal Sn_ave by calculating the maximum average signal of the first color signals and the minimum average signal of the first color signals, Sn_ave=1−minn_ave/maxn_ave;

calculating a maximum average signal of the second color signals max'n_ave and a minimum average signal of the second color signals min'n_ave;

obtaining the second average color saturation signal S'n_ave by calculating the maximum average signal of the second color signals and the minimum average signal of the second color signals. S'n_av=1−min'n_ave/max'n_ave; and calculating the light source adjustment coefficient y according to the first average color saturation signal and the second average color saturation signal, and the light source adjustment coefficient y satisfies following formulas:

$$Sn_ave=1-minn_ave/maxn_ave=1-min'n_ave/(max'n_ave*y);\ \text{and}$$

y=(min'n_ave)maxn_ave)/(minn_ave*max'n_ave). In the embodiment, a saturation calculation of each pixel is omitted, and only the r, g, b color signals of each of the backlight partitions are averaged to calculate the average color saturation signals of the overall backlight partitions, which reduces a calculation complexity. To be specific, to calculate the maximum average signal of the first color signals maxn_ave of all the pixels corresponding to the first color signals and the minimum average signal of the first color signals minn_ave of all the pixels corresponding to the first color signals, and calculate the maximum average signal of the second color signals max'n_ave of all the pixels corresponding to the second color signals and the minimum average signal of the second color signals min'n_ave of all the pixels corresponding to the second color signals. And then calculate the first average color saturation signal and the second average color saturation signal by the formula S=1−min/max. Thus, the light source adjustment coefficient is calculated based on the first average color saturation signal and the second average color saturation signal. The light source adjustment coefficient is configured to adjust a value of max'n_ave in the step of adjusting the intensity of the light sources, so that the third color average saturation signal after the adjustment is equal to the first color average saturation signal, and the intensity of the light sources is adjusted by the light source adjustment coefficient, which improve the color deviation, and reduces color saturation damage to the display.

To be specific, a calculating step of the first average color saturation signal Sn_ave includes:

obtaining first color signals Rn_i, j, Gn_i, j, Bn_j, j, and converting each group of RGB three primary color sub-pixel grayscale signals into three primary color normalized luminance signals r, g, b; and obtain the first normalized luminance signals rn_i,j,gn_i,j,bn_i,j after completing the conversion;

calculating the red sub-pixel average signal m_ave, the green sub-pixel average signal gn-ave, and the blue sub-pixel average signal bn-ave of the first color signals of all pixels in the current backlight partitions corresponding to the current frame; and calculating the maximum average signal of the first color signals and the minimum average signal of the first color signals minn-ave among the three sub-pixel average signals.

The first average color saturation signal is calculated based on the maximum average signal of the first color signals and the minimum average signal of the first color signals, Sn_ave=1−minn_ave/maxn_ave. And r=(R/255)^r, g=(G/255)^γg, b(B/255)^γb, and γr, γg, γb are gamma signals of the first color signals.

The R, G, B refer to the RGB three primary color grayscale digital signals corresponding to the first color signals.

The maximum average signal of the first color signals maxn_ave=Max(rn_ave, gn_ave, bn_ave) and the minimum average signal of the first color signals minn_ave=Min (rn_ave, gn_ave, bn_ave), and m_ave=Average(rn_1,1rn_1, 2, . . . , rn_i,j), gn_ave=Average(gn_1,1, gn_1,2, . . . , gn_i, j); bn_ave=Average(bn_1,1, bn_1,2, . . . bn_i,j).

Correspondingly, a calculating step of the second average color saturation signal Sn_ave includes:

obtaining second color signals R'n_i j, G'n_i, j, B'n_i, j, and converting each group of RGB three primary color sub-pixel grayscale signals into three primary color normalized luminance signals r', g', b', and obtain the second normalized luminance signals r'n_i,j, g'n)i,j, b'n_i,j after completing the conversion;

calculating the red sub-pixel average signal r'n_ave, the green sub-pixel average signal g'n-ave, and the blue sub-pixel average signal b'n-ave of the second color signals of all pixels in the current backlight partitions corresponding to the current frame;

calculating the maximum average signal of the second color signals by max'n_ave=Max(r'n_ave, g'n_ave, b'n_ave) among the three sub-pixel average signals and calculating the minimum average signal of the second color signals min'n_ave=Min(r'n_ave, g'n_ave, b'n_ave) among the three sub-pixel average signals; and obtaining the second average color saturation signal by calculating the maximum average signal of the second color signals and the minimum average signal of the second color signals, and S'n_ave=1−min'n_ave/max'n_ave.

r'=(R'/255)^γr, g'=(G'/255)^γg, b'=(B'/255)^γb, and γ'r, γ'g, γ'b are gamma signals of the second color signals.

The R', G', B' refer to the RGB three primary color grayscale digital signals corresponding to the second color signals.

The maximum average signal of the second color signals max'n_ave=Max(r'n_ave, g'n_ave, b'n_ave), and the minimum average signal of the second color signals min'n_ave=Min(r'n_ave, g'n_ave, b'n_ave), and r'n_ave=Average(r'n_1,1, rn_1,2, . . . , rn_i,j); g'n_ave=Average(g'n_1,1, g'n_1,2, . . . , g'n_i,j), and b'n_ave=Average(b'n_1,1, b'n_1,2, . . . , b'n_i,j). In the embodiment, all R, G, B sub-pixels is a group of unit pixels in the backlight partition, and are converted into HSV systems from the RGB system. That is, the first normalized luminance signals rn_i, j, gn_i, j, bn_i, j are obtained according to a normalization operation of the stimulation value signals Rn_i, j, Gn_i, j, Bn_i, j, then calculate the first color space signals based on the first normalized luminance signals. And then performing a process of adjusting the color saturation signals of the first color space signals, and the second normalized luminance signals are obtained according to the normalization operation based on the adjusted second color space signals, and then inversely convert to get the corresponding stimulation function r'n_i,j, g'n_i,j, b'n_i, j. Then, the first average color saturation signal and the second average color saturation signal are calculated based on the original stimulation function rn_i,j, gn_i,j, bn_i,j and new stimulation value signals r'n_i,j, g'n_i,j, b'n_i,j. Since the brightness stimulation value of each unit pixel is actually calculated during the calculation process, the final calculated light source adjustment coefficient is calculated based on a comparison of actual pixel presentations. Thus, the calculated light source adjustment coefficient y is accurate, which enhances the color saturation compensation effect, and is well to compensate the loss of the color saturation while improving the color deviation.

In one embodiment, the calculation of the light source adjustment coefficient is obtained by the following method:

To be specific, the calculation of the light source adjustment coefficient includes steps:

calculating the first average color saturation signal corresponding to the first color space signals by the formula Sn_ave=Average(Sn_1,1, Sn_1,2, . . . , Sn_i,j); and calculating the second average color saturation signal corresponding to the second color space signals by the formula S'n_ave=Average(S'n_1,1, S'n_1,2, . . . , S'n_i,j).

The light source adjustment coefficient is obtained by calculating the first average color saturation signal and the second average color saturation signal. In the embodiment, all the first color space signals and the second color space signals are obtained in units of one backlight partition, and the color saturation signals are captured, and all the color saturation signals are averaged to calculate the light source adjustment coefficient, such that the color deviation of the backlight partitions of the display panel improves, and the backlight partitions is integrated as one. And each of the backlight partitions separately compensates the color saturation to maintain a good solid color performance of colors.

To be specific, the step of calculating the light source adjustment coefficient according to the first average color saturation signal and the second average color saturation signal includes steps: calculating the first average color saturation signal by the formula Sn_ave=1−minn_ave/maxn_ave; and calculating the second average color saturation signal by the formula S'n_ave=1−min'n_ave/max'n_ave;

obtaining a third average color saturation signal S"n_ave according to the light source adjustment coefficient and the second average color saturation signal;

max'n_ave=maxn_ave, and the light source adjustment coefficient y satisfies following formulas:

$$S'n_ave = Sn_ave;$$

$$1-minn_ave/maxn_ave = 1-min'n_ave/(max'n_ave*y);$$

and $$y=(S'n_ave-1)/(Sn_ave-1).$$

The maxn_ave is the maximum average signal of the first color signals among the red sub-pixel average signal, the green sub-pixel average signal, and the blue sub-pixel average signal of the first color signals of all pixels in the current backlight partitions corresponding to the current frame, and minn_ave is the minimum average signal of the first color signals among the red sub-pixel average signal, the green sub-pixel average signal, and the blue sub-pixel average signal of the first color signals of all pixels in the current backlight partitions corresponding to the current frame.

The max'n_ave is the maximum average signal of the second color signals among a red sub-pixel average signal, a green sub-pixel average signal, and a blue sub-pixel average signal of the second color signals of all pixels in the current backlight partitions corresponding to the current frame, and min'n_ave is the minimum average signal of the second color signals among the red sub-pixel average signal, the green sub-pixel average signal, and the blue sub-pixel average signal of the second color signals of all pixels in the current backlight partitions corresponding to the current frame.

In the embodiment, the maximum average signal of the second color signals is same as the maximum average signal of the first color signals. Since in the color saturation process, maxi,j of each pixel is unchanged, and mini,j of each pixel is adjust, thus the external maxn_ave is unchanged. There is no need to calculate minn_ave, maxn_ave, and min'n ave of the formulas Sn_ave=1−minn_ave/maxn_ave, and S'n_ave=1−min'n_ave/maxn_ave, but they can be estimated by the color saturation signal. The calculated values are configured to assist the calculation, and finally the light source adjustment coefficient is obtained by the formula y=(S'n_ave−1)/(Sn_ave−1). The light source adjustment coefficient is obtained by the formula Sn_ave=Average(Sn_1,1, Sn_1,2, . . . , Sn_i,j), and the formula S'n_ave=Average(S'n_1,1, S'n_1,2, . . . , S'n_i,j). And the light source adjustment coefficient is calculated based on the overall color saturation difference of the backlight partitions, which ensures that the color saturation of the backlight partition is well compensated.

In one embodiment, in the step of adjusting the color saturation, the corresponding predetermined adjustment coefficients are needed to be obtained, and the current color saturation signals are lowered to adjust the color saturation values.

The step of adjusting the color saturation of the first color space signals by the predetermined adjustment coefficients to obtain the second color space signals in the HSV system includes steps:

obtaining current color saturation signals of the first color space signals, detecting whether the current color saturation signals satisfy a predetermined color saturation threshold, and detecting whether the current color saturation signals are in an adjusted hue interval, and if yes, obtaining corresponding predetermined adjustment coefficients according to the corresponding color saturation values and corresponding hue intervals based on the color saturation signals; and adjusting the current color saturation, signals to obtain the second color space signals in the HSV system by the predetermined adjustment coefficients.

The predetermined adjustment coefficients are calculated by calculating the color saturation signals according to a predetermined calculation formula or by looking up in a predetermined adjustment coefficient look up table.

The color saturation threshold is 0.5, and if the color saturation values of the current color saturation signals are more than 0.5, the color saturation values of the current color saturation signals satisfy the color saturation threshold. Or the color saturation threshold is an interval, e.g. 0.5-1, that is, the color saturation threshold is more than 0.5 and less than 1. When the color saturation threshold is more than 0.5 and less than 1, the color saturation is adjusted. When the color saturation threshold is 0.5 or 1, there is no need to adjust the color saturation. In the embodiment, only part of the color saturation signals are adjusted, and the part of the color saturation signals not only need to satisfy the color saturation threshold, but also need to satisfy the hue interval. Since correspondences between color saturation values of different hue intervals and different color deviations are different. The greater the color saturation values, the more severe the color deviation is. In addition, the closer to the dominant hue, the more severe the color deviation is. For example, in a same color saturation value, the color deviation in the mite interval corresponding to a blue dominant hue of a 240-degree hue is far more than an unadjusted hue interval of a 300-degree hue. At this time, even the color saturation signals of a 300-degree hue satisfies the color saturation threshold, a degree of the color deviation is small and does not need to be improved. Similarly, if the color saturation values are high, but the hue interval is, appropriate, the color deviation of the corresponding color saturation signals may not be particularly serious and does not need to be adjusted. Thus, only the color saturation signals satisfy both of the color saturation threshold and the hue interval are needed to be adjusted. For example, to reduce the color saturation values is able to improve the color deviation, and to avoid unnecessary processing for signals that does not need the color deviation adjustment (such as lowering the color saturation values), thereby improving the display of the display panel.

Optionally, the step of lowering the current color saturation signals S by the corresponding predetermined adjustment coefficients; completing the adjustment of the color saturation signals to obtain second color saturation signals S'; and converting the second color saturation signals into the second color space signals in the HSV system includes obtaining the third color saturation signals S" by calculating the current color saturation signals S and the second color saturation signals S"; completing two times of color saturation adjustment; and obtaining the second color space signals in the HSV system based on the third color saturation signals.

Converting the second color space signals into the second color signals in the RGB system to drive the display panel.

Figure 7:
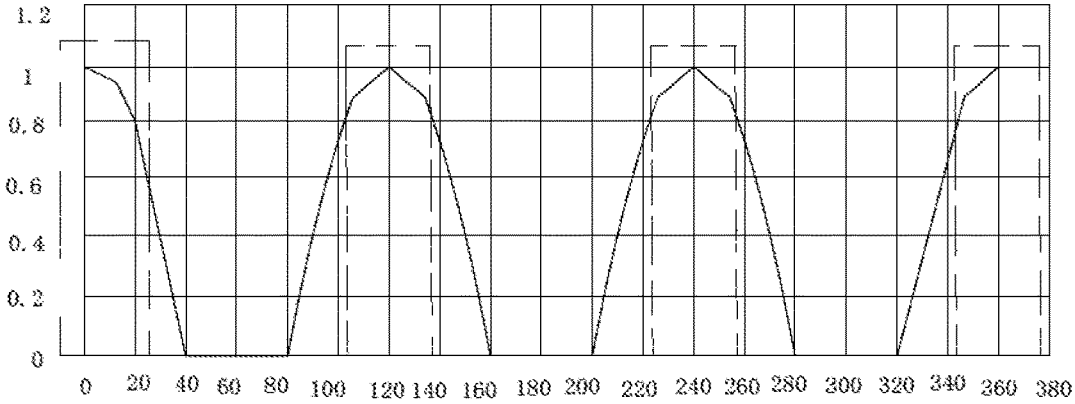
FIG. 7 is a schematic diagram of a correlation function of a second predetermined adjustment coefficient H2 in one embodiment of the present disclosure.

FIG. 7 is a schematic diagram of a correlation function of a second predetermined adjustment coefficient H2 in one embodiment of the present disclosure. As shown in FIG. 7, and combined with FIGS. 4 to 6, the third color saturation signals satisfies a following formula:

$$S''=S-(S-S')*H2.$$

The second predetermined adjustment coefficient $H2$ satisfies a following formula:

$$H2=2*\mathrm{ABS}(\sin((\mathrm{Hue}/360*3-1/2)*\pi)-1.$$

In the embodiment, the second predetermined adjustment coefficients H2 is an adjustment coefficient configured to adjust the second color saturation signals into the third color saturation signals. In the RGB system, degree is defined as a red solid color hue, 120 degrees is defined as a green solid color hue, and 240 degrees is defined as a blue solid color hue. In the same color saturation value, the closer to the solid color hue, the more severe the color deviation is. Base on the second predetermined adjustment coefficients H2, the color saturation signals closer to the solid color hue obtains a larger secondary adjustment, and the color saturation signals away from the solid color hue obtains a small amplitude secondary adjustment. In this way, the color saturation signals near the solid color hue achieves a effect of improving the color deviation, while for the color saturation signals away from the solid color hue, the overall color saturation damage caused by the improvement of the color deviation is lowered. Thus, The balance of the color deviation and the color saturation is achieved, which is beneficial to improve the display of the display panel.

The step of obtaining the light source adjustment coefficient according to the first color space signals and the second color space signals includes steps: obtaining the maximum average signal of the second color saturation signals by max'n_ave=Max(r'n_ave, g'n_ave); and using a color light source corresponding to the maximum average signal of the second color saturation signals as the dominant hue light source. In the embodiment, the dominant hue light source is found based on the maximum average signal of the second color saturation signals. And only the dominant hue light source is adjusted, since in the color saturation adjustment stage, the color deviation of the solid color hue is more severe, when the color saturation adjustment is performed, color saturation signals of the solid color hues or the signals corresponding to the dominant hue light source are adjusted. At the moment, in turn, the dominant hue light source is compensated to compensate the loss of the color saturation due to compensate for the improvement of the color deviation. Thus, the corresponding compensation effect is achieved, the color deviation is improved, the color saturation is improved, the balance of the color deviation and color saturation is achieved, and the display of the display panel is improved.

In one embodiment, in the step of adjusting the color saturation, the corresponding predetermined adjustment coefficients are needed to be obtained, and the current color saturation signals are lowered to adjust the color saturation values.

The step of adjusting the color saturation of the first color space signals by the predetermined adjustment coefficients to obtain the second color space signals in the HSV system includes, steps:

obtaining current color saturation signals of the first color space signals, detecting whether the current color saturation signals satisfy a predetermined color saturation threshold, and detecting whether the current color saturation signals are in an adjusted hue interval, and if yes, obtaining corresponding predetermined adjustment coefficients according to the corresponding color saturation values and corresponding hue intervals based on the color saturation signals; and adjusting the current color saturation signals to obtain the second color space signals in the HSV system by the predetermined adjustment coefficients.

The predetermined adjustment coefficients are obtained by calculating the color saturation signals according to the predetermined calculation formula or by looking up in the predetermined adjustment coefficient look up table. In the embodiment, in the RGB system, the higher the color saturation of the signals, the more severe the color deviation is. Thus, the color deviation of some of the color saturation values is severe, and the color deviation of some of the color saturation values is not obvious and is in an acceptable range. The color saturation signals with severe color saturation are sift out by the hue interval and the predetermined threshold. For example, to lower the color saturation values is able to improve the color deviation, and avoid unnecessary processing for signals that does not need the color deviation adjustment (such as lowering the color saturation values), thereby improving the display of the display panel.

The predetermined adjustment coefficient look up table is a look up table directly recorded with predetermined adjustment coefficients or a look up table recording a predetermined calculation formula.

The second color space signals and the first color space signals conform to a following formula:

$$S'=a*S4+b*S3+c*S2+d*S+e;$$

S is the current color saturation signals corresponding to the first color space signals, and S' is the color saturation signal corresponding to the second color space signals. The a, b, c, d, e are constants, and the a, b, c, d, e are obtained by looking up in the predetermined formula coefficient look up table according to the different color saturation values and the different hue intervals. In the embodiment, the predetermined adjustment coefficients are calculated according to the predetermined calculation formulas, and although the calculation formulas are different, it is generally satisfied with the fourth-order polynomial. The a, b, c, d, e are constants, and the a, b, c, d, e are obtained by looking up in the predetermined formula coefficient look up table according to the different color saturation values and the different hue intervals. Of course, other calculation formulas are also applicable. For example, when the color saturation value S satisfies certain conditions, the predetermined adjustment coefficient is equal to the square root of S. When the color saturation value S satisfies another condition, the predetermined adjustment coefficient is equal to the cubic root of S.

To be specific, after determining the predetermined adjustment coefficients, the step of using the predetermined adjustment coefficients, that is, the step of converting the first color signals into the first color space signals in the HSV system includes following steps:

receiving the first color signals in the RGB system, obtaining first color signals Rn_i, j, Gn_i, j, Bn_i, j, and converting each group of RGB three primary color sub-pixel grayscale signals into three primary color normalized luminance signals r, g, b, and obtaining the first normalized luminance signals rn_i,j,gn_i,j,bn_i,j after completing the conversion;

calculating the current color saturation signals according to the first normalized luminance signals by S=1−mini,j/maxi,j, and obtaining the first predetermined adjustment coefficients H1 corresponding to the current color saturation signals keeping maxi, j unchanged, and adjusting the mini, j by the first predetermined adjustment coefficients H1 to obtain the second color saturation signals, and S'=1−mini, j*H/maxi,j;

convening the second color saturation signals S' into the second color signals in the RGB system; and driving the display panel by the second color signals, and mini,j=min(rn_i,j, gn_i,j, bn_i,j), and maxi,j=max(rn_i,j, gn_i,j, bn_i,j).

In the present disclosure, in the RGB system, the greater the color saturation of the signal, the more severe the color deviation is. In order to improve the color deviation, the color saturation signals with a high color saturation value need to be adjusted to lower the color saturation value. To be specific, the color saturation signals S−1−mini, j/maxi, j, where the mini, j and maxi, j are variables. The color saturation values are adjusted by adjusting the mini, j and maxi, j. In the embodiment, the maxi, j does not change, the adjustment is completed by increasing the mini, j, thereby achieving the purpose of lowering the color saturation values. After such adjustment, the color saturation signals, especially the color saturation signals whose color saturation value is too high, is lowered to improve the color deviation. In addition, the embodiment is not based on the sacrifice of the light-transmissive opening region, thus, a light transmittance is prevented from being lowered, and production costs of the display panel is lowered. Further, since the mini, j is increasing, the brightness of the mini, j is also increasing, thereby improving the overall brightness of die display panel while improving the color deviation, thus, a good display effect is achieved.

Where Sn_i,j=1−minn_i,j/maxn_i,j, and minn_i,j=min(r, g,b). maxn_i,j=max(r,g,b). Where r=(R/255)^γr, g=(G/255)^γg, b=(B/255)^γb. And where the γr, γg, γb are gamma signals of the first color signals. The R, G, B refer to the RGB three primary color grayscale digital signals corresponding to the first color signals.

In one embodiment, in the step of adjusting the color saturation, the corresponding predetermined adjustment coefficients are needed to be obtained, and the current color saturation signals are lowered to adjust the color saturation value.

The step of lowering the color saturation value of the current color saturation signals by the predetermined adjustment coefficients includes steps: obtaining current color saturation signals of the first color space signals, detecting whether the current color saturation signals satisfy the predetermined color saturation threshold, and detecting whether the current color saturation signals are in an adjusted hue interval, and if yes, obtaining corresponding predetermined adjustment coefficients according to the corresponding color saturation values and corresponding hue intervals based on the color saturation signals. In the embodiment, only part of the color saturation signals are adjusted, and the part of the color saturation signals not only need to satisfy the color saturation threshold, but also need to satisfy the hue interval. Since the correspondences between color saturation values of different hue intervals and different color deviations are different. The greater the color saturation values, the more severe the color deviation is. In addition, the closer to the dominant hue, the more severe the color deviation is. For example, in the same color saturation value, the color deviation in the hue interval corresponding to the blue dominant hue of the 240-degree hue is far more than the unadjusted hue interval of the 300-degree hue. At this time, even the color saturation signals of a 300-degree hue satisfies the color saturation threshold, the degree of the color deviation is small and does not need to be improved. Similarly, if the color saturation value is high, but the hue interval is appropriate, the color deviation of the corresponding color saturation signals may not be particularly serious and does not need to be adjusted. Thus, only the color saturation signals satisfy both of the color saturation threshold and the hue interval are needed to be adjusted. For example, to reduce the color saturation value is able to improve the color deviation, and avoid unnecessary processing for signals that does not need the color deviation adjustment (such as lowering the color saturation value), thereby improving the display of the display panel.

To be specific, receiving the first color signals in the RGB system;

obtaining first color signals Rn_i, j, Gn_i, j, Bn_i, j, and converting each group of RGB three primary color sub-pixel grayscale signals into three primary color normalized luminance signals r, g, b; and obtaining the first normalized luminance signals rn_i,j,gn_i,j,bn_i,j after completing the conversion;

calculating the current color saturation signals according to the first normalized luminance signals by S=1−mini,j/maxi,j, and obtaining the predetermined adjustment coefficients H corresponding to the current color saturation signals;

keeping maxi, j unchanged, and adjusting the mini, j by the predetermined adjustment coefficients H to obtain the second color saturation signals, and S'=1−mini,j*H/maxi,j; and converting the second color saturation signals S' into the second color signals in the RGB system to drive the display panel, where mini,j=min(rn_i,j, gn_i,j, bn_i,j), and maxi, j=max(rn_i,j, gn_i,j, bn_i,j).

The color saturation signals is split into at least a first hue interval, a second hue interval, and a third hue interval according to different hues. In the step of obtaining the predetermined adjustment coefficients H corresponding to the current color saturation signals:

when corresponding to a same hue, the greater the color saturation values of tire current color saturation signals, the greater an adjustment amplitude of an adjustment process is. In the embodiment, in the same hue interval, especially in the same hue, the higher the color saturation values of the color saturation signals, the more severe the corresponding color deviation is. Therefore, the adjustment amplitude for the signals with a high color saturation value is large, and the adjustment amplitude for the signals with a low color saturation value is small. In generally, the color saturation values of the color saturation signals are lowered, thus, the color deviation caused by the high color saturation is avoided, the color deviation caused by excessive color saturation difference is avoided, and a effect of the improvement of the color deviation is achieved. Of course, it is possible to increase the value of the color saturation signals with a low color saturation value, which makes the color saturation signals more uniform and also improves the color deviation to some extent. In addition, the adjustment amplitude herein refers to lower the amplitude of the color saturation signals. The larger the color saturation values, the corresponding predetermined adjustment coefficient may be smaller or larger according to different calculation formulas. However, an effect of the adjustment amplitude is constant. For example, if the predetermined adjustment coefficient are the coefficient of the overall color saturation signals, e. g. S'=S*H (where S is the current color saturation signals and S' is the second color saturation signals, H is the predetermined adjustment coefficients), the greater the adjustment amplitude of lowering the value the smaller the value of the predetermined adjustment coefficients. If the predetermined adjustment coefficient is the coefficient of one of the parameters of the color saturation signals, e. g. S'=1−min*H/max (where S is the current color saturation signal S' is the second color saturation signal, and H is the predetermined adjustment coefficient), the greater the adjustment amplitude of lowering the value, the greater the corresponding coefficient is. The larger the predetermined adjustment coefficient at this time, the larger the corresponding reduction adjustment amplitude is.

To be specific, the first hue interval, the second hue interval, and the third hue interval are defined as a red hue interval, a green hue interval, and a blue hue interval respectively. In the current color saturation signals having the same color saturation value, an adjustment amplitude of the predetermined color adjustment signals corresponding to the blue hue interval to the current color saturation signals is greater than an adjustment amplitude of the predetermined color adjustment signals corresponding to the red hue interval to the current color saturation signals. The adjustment amplitude of the predetermined color adjustment signals corresponding to the red hue interval to the current color saturation signals is greater than an adjustment amplitude of the predetermined color adjustment signals corresponding to the green hue interval to the current color saturation signals.

In the embodiment, the degrees of color deviation of the color saturation signals in different hue intervals are different. In the same color saturation value, the color deviation of some of the hue intervals is severe, and the color deviation of some hue intervals is light. In RGB system, the color deviation of color saturation signals in the blue hue interval is the most severe, and the color deviation of color saturation signals in the green hue interval is lighter. In this scheme, taking S'=S*H as an example, the predetermined adjustment coefficients corresponding to the blue hue interval are smaller than the predetermined adjustment coefficients corresponding to the red hue interval, and the predetermined adjustment coefficients corresponding to the red hue interval are smaller than the predetermined adjustment coefficients corresponding to the green hue interval. The smaller the predetermined adjustment coefficients, the larger the adjustment amplitude is. Correspondingly, taking S'=1−min*H/max as an example, the predetermined adjustment coefficients corresponding to the blue hue interval are the largest among the hue intervals and the adjustment amplitude is the largest, and the predetermined adjustment coefficients corresponding to the green hue interval are the smallest among the hue intervals and the adjustment amplitude is the smallest. Thus, in the same color saturation value, the color saturation signals in the blue hue interval have the larger reduction adjustment amplitude, and the color saturation signals in the green hue interval have the smaller reduction adjustment amplitude, which not only reduce the color deviation caused by the large color saturation values, but also make the color saturation of the color saturation signals more uniform, and also help to improve color deviation to some extent. Thus, the good improvement in color deviation is achieved.

In one embodiment, the color saturation signals are split into a red hue interval, a green hue interval, a blue hue interval, and an unadjusted hue interval according to different hue intervals.

A hue value ranges from 0-360, corresponding to 0-360 degrees.

The hue value of a hue interval satisfying a following formula is the red hue interval: 0≤Hue<40, or 320<Hue≤360. The hue value of the hue interval satisfying a following formula is the green hue interval: 80<Hue<160. The hue value of the hue interval satisfying a following formula is the blue hue interval: 40≤Hue≤80, or 160≤Hue≤200. The hue value of the hue interval satisfying the following formula is the unadjusted hue interval: 40≤Hue≤80, or 160≤Hue≤200, or 280≤Hue≤320.

In the embodiment, in view of the RGB system, 0 degree is defined as a red hue, 120 degrees is defined as a green hue, and 240 degrees is defined as a blue hue. Under the premise of the same color saturation value, the closer to the red hue, the green hue, and the blue hue, the more severe the color deviation is. The farther away from the red hue, the green hue, and the blue hue, the lighter the color deviation of the color saturation signals is, and even the color saturation signals conform to the color deviation standard and does not need to be adjusted. In the embodiment, the hues close to the green hue is defined as the green hue interval, the hues close to the blue hue is defined as the blue hue interval, the hues close to the red hue is defined as a red hue interval, and the hues away from the red hue, the green hue, and the blue hue is defined as the unadjusted internal. Thus, corresponding to the same color saturation value, the predetermined adjustment coefficients of the blue hue interval having the most severe color deviation are set to be large, the predetermined adjustment coefficients of the green hue interval having the lightest color deviation are set to be small, and for the unadjusted hue interval where there is almost no color deviation, no adjustment is made, or the corresponding predetermined adjustment coefficients is set to be 1. In this way, the color deviation is improving, the decrease of the color saturation values are avoided, which is beneficial to improve the display of the display panel.

Optionally, the step of lowering the current color saturation signals S by the corresponding predetermined adjustment coefficients; completing the adjustment of the color saturation signals to obtain second color saturation signals S'; and converting the second color saturation signals into the second color space signals in the HSV system includes steps: obtaining the third color saturation signals S" by calculating the current color saturation signals S and the second color saturation signals S'; completing two times of color saturation adjustment; and obtaining the second color space signals in the HSV system based on the third color saturation signals; and converting the second color space signals into the second color signals in the RGB system to drive the display panel.

Figure 8:
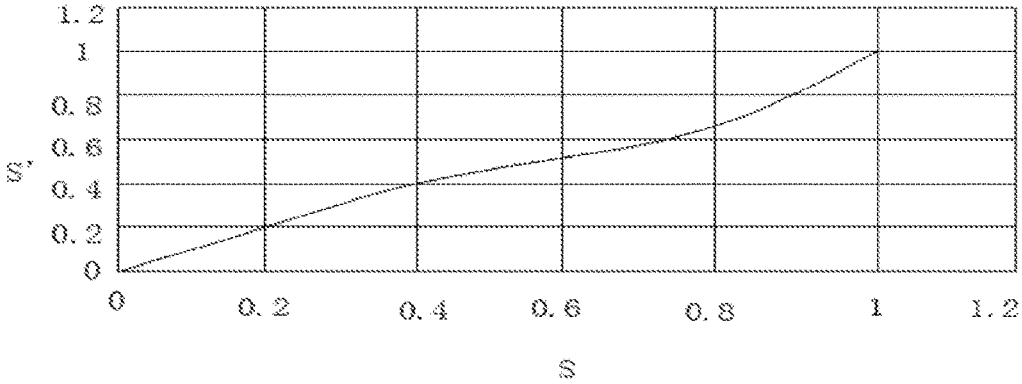
FIG. 8 is a schematic diagram of variations of a current color saturation signal and the second color saturation signal according to one embodiment of the present disclosure.
Figure 9:
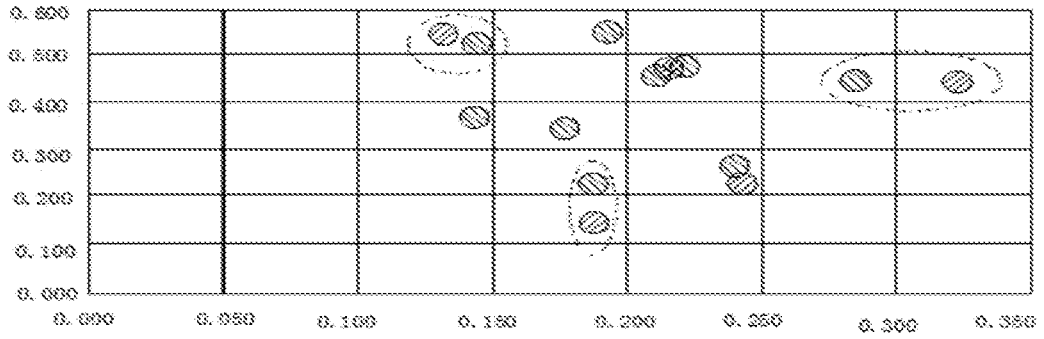
FIG. 9 is a graph showing aberration variations of the current color saturation signal and the second color saturation signal according to one embodiment of the present disclosure.
Figure 10:
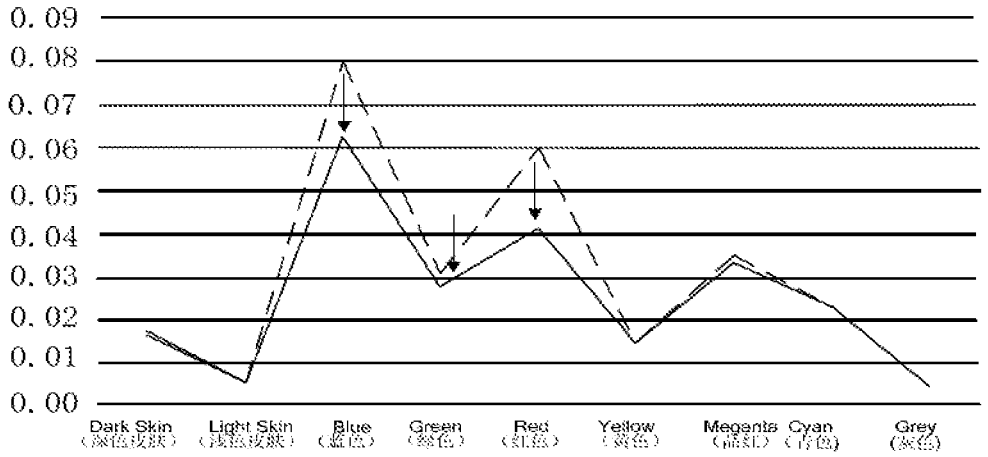
FIG. 10 is a schematic diagram of aberration variations of the current color saturation signal and the second color saturation signal according to one embodiment of the present disclosure.

In the color saturation adjustment stage:

FIG. 8 is a schematic diagram of variations of a current color saturation signal and a second color saturation signal according to one embodiment of the present disclosure FIG. 9 is a graph showing a aberration variation of the current color saturation signal and the second color saturation signal according to one embodiment of the present disclosure. FIG. 10 is a schematic diagram of aberration variations of the current color saturation signal and the second color saturation signal according to one embodiment of the present disclosure.

The graph of the aberration variation shown in FIG. 9 may be in the case of a front viewing angle, of course; it can also be in the case of a side viewing angle. The dotted line in FIG. 10 is the aberration variation corresponding to the current color saturation signal in various color systems, and the solid line is the aberration variation corresponding to the second color saturation signal in various color systems.

To be specific, the input signals of the display is RGB three primary color signals. If the display is driven by 8 bit color resolution, the tone of the RGB three primary color input signals are decomposed into 0, 1, 2255 grayscale drive signals. In the present disclosure, the RGB three primary color signals are converted into HSV color space signals, and the color saturation is adjusted according to different hues and different color saturation values in the color space of the HSV to achieve the effect of the improvement of the color deviation.

Referring to FIG. 1, it shows the color deviation variations of a wide viewing angle and a front view of various representative color systems of the liquid crystal display. It is obvious that the color deviation of R, G, and B hues is more severe than that of other colors. Therefore, solving the color deviation of the r, g, and b hues is able to greatly improve the overall color deviation viewing from the wide viewing angle.

The calculation method of converting the color signals in the RGB system or the RGB three primary color signals into HSV signals is as follows: the input signals of the RGB three primary colors are 8-bit grayscale digital signals of 0, 1, . . . 255, and each grayscale digital signal corresponding to the luminance normalized signal of the 255 input signals (the 255 grayscale is the maximum luminance) is r, g, b, respectively; where r=(R/255)^γr, g=(G/255)^γg, b=(B/255)^γb, where γr, γg, γb are gamma signals, and grayscale digital signals is converted into an exponential parameter of the luminance signal. H is a hue signal, and r, g, b normalized luminance signals are converted into a hue h and a saturation s signal. Among them, H is a color representation, which is represented by different degrees of hues from 0 degree to 360 degrees, where 0 degree is defined as red, 120 degrees is green, and 240 degrees is blue. Where R is a red grayscale digital signal, G is a green grayscale digital signal, B is a blue grayscale digital signal. Where min is the minimum of r, g, b, and max is the maximum of r, g, b.

The conversion relationship between r, g, b normalized luminance signals and hue h, and the saturation signals S conform to a following formula:

$$h = \begin{cases} 0^\circ & \text{if } \max = \min \\ 60^\circ \times \dfrac{g-b}{\max - \min} + 0^\circ & \text{if } \max = r \text{ and } g \geq b \\ 60^\circ \times \dfrac{g-b}{\max - \min} + 360^\circ & \text{if } \max = r \text{ and } g < b \\ 60^\circ \times \dfrac{b-r}{\max - \min} + 120^\circ & \text{if } \max = g \\ 60^\circ \times \dfrac{r-g}{\max - \min} + 240^\circ & \text{if } \max = b \end{cases}$$

$$s = \begin{cases} 0^\circ & \text{if } \max = 0 \\ 1 - \dfrac{\min}{\max}, & \text{otherwise} \end{cases}$$

In summary, when the hue is close to the R, G, B solid color hue, the color deviation deterioration of the wide viewing angle is more obvious. And when the hue is close to the R, G, B solid color hue, the greater the color saturation s, the more obvious the color deviation is. The color saturation s of the R, G, B solid color hues are lowered to improve the color viewed from the wide viewing angle comparing to the color viewed from the front view angel, that is, the closer to the solid color hue, the greater the adjustment amplitude is. In addition, after completing the color saturation adjustment, a detection step is added. For example, converting the color saturation signals into the Commission Internationale De l'Eclairage Lu'v'color space signals, where L is a luminance coordinate and u' and v' are chroma coordinates. In order to improve the color deviation, the color saturation adjustment is to lower the color saturation values of the current color saturation signals, but if it is to reduce a loss of the color saturation, the solid color changes, that is, the current color saturation signals S are changed to the second color saturation signals S'. And the solid color change or the aberration Δuv should satisfy: $\Delta uv=\sqrt{((u_1-u_2)^2+(v_1-v_2)/2)}\leq 0.02$. Where u_1 and v_1 are the chroma coordinates of the current color saturation signal, and u_2 and v_2 are the aroma coordinates of the second color saturation signals which are the color saturation signal after the color saturation adjustment.

Figure 11:
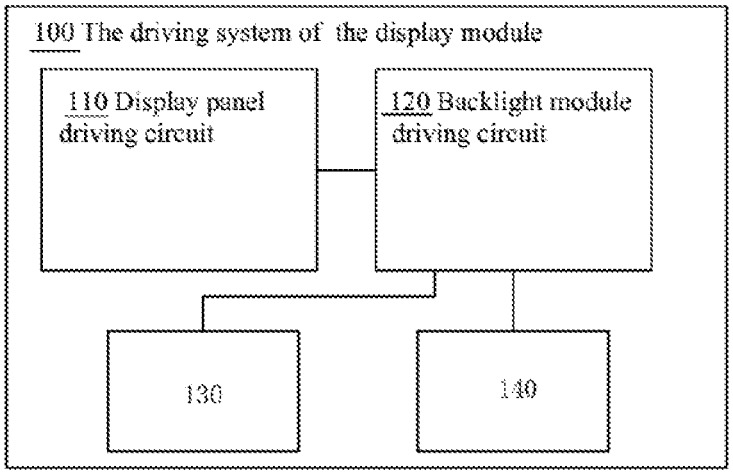
FIG. 11 is a schematic diagram of a driving system of a display panel according to one embodiment of the present disclosure.
Figure 12:
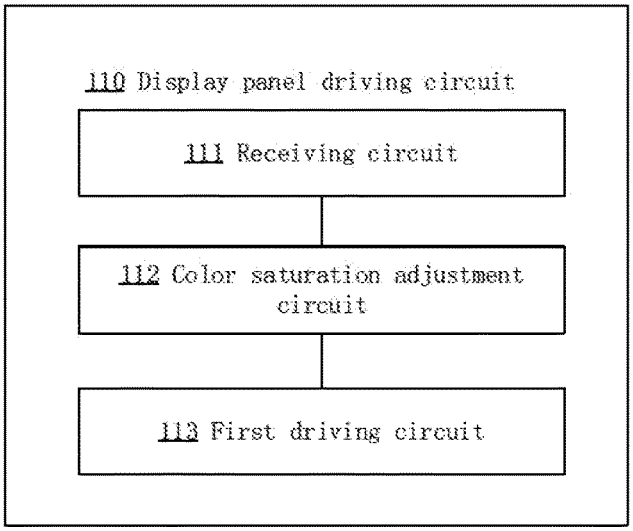
FIG. 12 is a schematic diagram of a driving circuit of a display panel according to one embodiment of the present disclosure.
Figure 13:
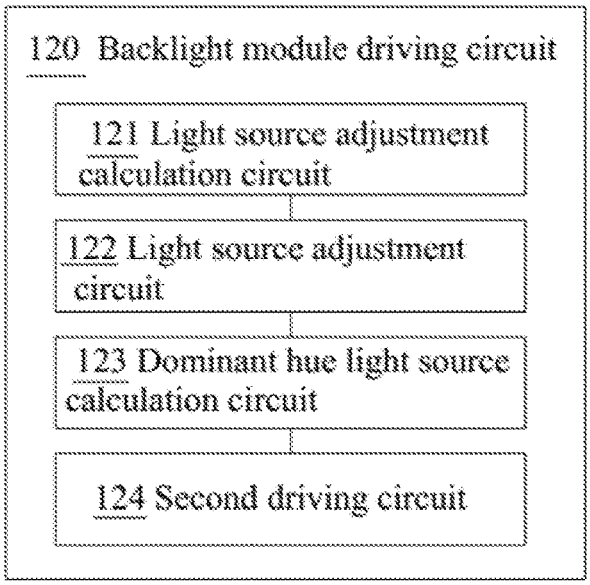
FIG. 13 is a schematic diagram of a driving circuit of a backlight module according to one embodiment of the present disclosure.

FIG. 11 is a schematic diagram of a driving system of a display panel according to one embodiment of the present disclosure. FIG. 12 is a schematic diagram of a driving circuit of a display panel according to one embodiment of the present disclosure. FIG. 13 is a schematic diagram of a driving circuit of a backlight module according to one embodiment of the present disclosure. As shown in FIGS. 11 to 13, and combined with FIGS. 1 to 10, the present disclosure further provides a driving system of a display module 100, on which the above driving method is applied. The driving system includes a display panel driving circuit 110, and a backlight module driving circuit 120 driven synchronously with the display panel driving circuit 110.

The display module includes a plurality of first color light sources 130 and second color light sources 140. The first color light sources 130 and the second color light sources 140 are controlled independently.

The display panel driving circuit 110 includes:

a receiving circuit 111 receiving first color signals in an RGB system corresponding to a display panel and converting the first color signals into first color space signals in an HSV system;

a color saturation adjustment circuit 112 adjusting a color saturation of the first color space signals by predetermined adjustment coefficients to obtain second color space signals in the HSV system, and converting the second color space signals into second color signals in the RGB system; and a first driving circuit 113 driving the display panel by the second color signals.

The backlight module driving circuit 120 includes:

a light source adjustment calculation circuit 121 receiving the first color signals in the RGB system corresponding to the display panel, and obtaining the first color space signals in the HSV system and the second color space signals in the HSV system, and obtains a light source adjustment coefficient according to the first color space signals and the second color space signals:

a light source adjustment circuit 122 using the light source adjustment coefficient to adjust a first brightness value corresponding to the first color light sources and/or the second color light sources to obtain a second brightness value;

a dominant hue light source calculation circuit 123 determining a dominant hue light source from the first color light sources and the second color light sources; and a second driving circuit 124 driving the dominant hue light source by the second brightness value.

Figure 14:
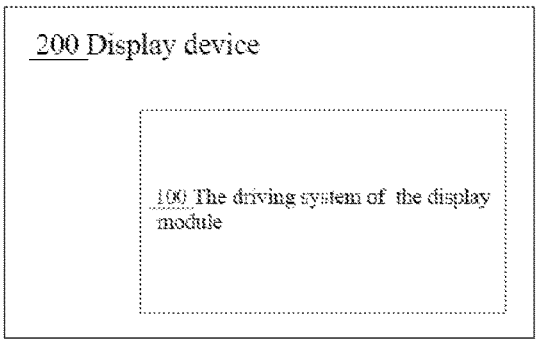
FIG. 14 is a schematic diagram of a display device according to one embodiment of the present disclosure.

FIG. 14 is a schematic diagram of a display device according to one embodiment of the present disclosure. As shown in FIG. 14, and combined with FIGS. 1 to 13, the present disclosure further provides a display device 200, including the driving system of the display module of the present disclosure.

It should be noted that the limitation of each step involved in the present disclosure is not determined to limit the sequence of steps, without affecting the implementation of the specific solution. Steps written in the foregoing can be executed first, or later, or even simultaneously as lone as the specific solutions can be implemented, which should be considered as the scope of the present disclosure.

The present disclosure is selected from a twisted-nematic (TN) type display panel, in-plane Switching (IPS) type display panel, and a vertical-alignment (VA) type display panel. Of course, the display panel can be other types of display panels which is able to be applied.

The technical solution of the present disclosure is able to be widely applied to various display panels, only if it is applicable.

The above content is a further detailed description of the present disclosure in conjunction with the specific embodiments, and the specific implementation of the present disclosure is not limited to the description. It will be apparent to those skilled in the art that a number of simple deductions or substitutions may be made without departing from the conception of the present disclosure, which should be considered as being within the scope of the present disclosure.

What is claimed is:

1. A driving method of a display module, comprising a display panel driving process, and a backlight module driving process driven synchronously with the display panel driving process;

wherein the display module comprises a plurality of first color light sources and second color light sources, the first color light sources and the second color light sources controlled independently;

wherein the display panel driving process comprises steps:

receiving first color signals in an RGB (red, green, blue) system corresponding to a display panel, and converting the first color signals into first color space signals in an HSV (hue, saturation, value) system;

adjusting a color saturation of the first color space signals by predetermined adjustment coefficients to obtain second color space signals in the HSV system, and converting the second color space signals into second color signals in the RGB system; and driving the display panel by the second color signals;

wherein the backlight module driving process comprises steps:

receiving the first color signals in the RGB system corresponding to the display panel, obtaining the first color space signals in the HSV system and the second color space signals in the HSV system, and obtaining a light source adjustment coefficient according to the first color space signals and the second color space signals;

adjusting a first brightness value corresponding to the first color light sources and/or the second color light sources by the light source adjustment coefficient to obtain a second brightness value;

determining a dominant hue light source from the first color light sources and the second color light sources; and driving the dominant hue light source by the second brightness value.

2. The driving method of the display module according to claim 1, wherein the display module is a direct-lit backlight display module; the direct-lit backlight display module comprises a plurality of backlight partitions, each of the backlight partitions comprises the plurality of the first color light sources and the second color light sources;

wherein each of the backlight partitions further comprises a plurality of third color light sources; the third color light sources are controlled independently;

wherein the step of determining the dominant hue light source comprises:

determining the dominant hue light source from the first color light sources, the second color light sources, and the third color light sources.

3. The driving method of the display module according to claim 2, wherein the step of obtaining the light source adjustment coefficient according to the first color space signals and the second color space signals comprises steps:

obtaining the first color space signals and the second color space signals of all pixels in current backlight partitions corresponding to a current frame, calculating a first average color saturation signal corresponding to the first color space signals and a second average color saturation signal corresponding to the second color space signals respectively; and obtaining the light source adjustment coefficient by calculating the first average color saturation signal and the second average color saturation signal.

4. The driving method of the display module according to claim 3, wherein the first color signals are RGB three dominant hue signals in the RGB system, and the first color signals comprises red sub-pixel signals, green sub-pixel signals, and blue sub-pixel signals;

wherein the step of obtaining the light source adjustment coefficient by calculating the first average color saturation signal and the second average color saturation signal comprises steps:

obtaining the first color signals of all pixels in the current backlight partitions corresponding to the current frame, calculating a maximum average signal of the first color signals maxn_ave and a minimum average signal of the first color signals minn_ave among a red sub-pixel average signal of the first color signals, a green sub-pixel average signal of the first color signals, and a blue sub-pixel average signal of the first color signals;

obtaining the first average color saturation signal Sn_ave by calculating the maximum average signal of the first color signals and the minimum average signal of the first color signals, wherein Sn_ave=1−minn_ave/maxn_ave;

calculating a maximum average signal of the second color signals max' n_ave and a minimum average signal of the second color signals min' n_ave;

obtaining the second average color saturation signal S' n_ave by calculating the maximum average signal of the second color signals and the minimum average signal of the second color signals, wherein S' n_av=1−min' n_ave/max' n_ave; and calculating the light source adjustment coefficient y according to the first average color saturation signal and the second average color saturation signal, and the light source adjustment coefficient y satisfies following formulas:

$$Sn_ave=1-minn_ave/maxn_ave=1-min'n_ave/(max'n_ave*y);\ \text{and}\ y=(min'n_ave*maxn_ave)/(minn_ave*max'n_ave).$$

5. The driving method of the display module according to claim 4, wherein the step of: determining the dominant hue light source from the first color light sources, the second color light sources, and the third color light sources comprises steps:

obtaining the maximum average signal of the second average color saturation signal by max' n_ave=Max(r' n_ave, g' n_ave, b' n_ave); and using a color light source corresponding to the maximum average signal as the dominant hue light source.

6. The driving method of the display module according to claim 3, wherein calculating the light source adjustment coefficient comprises steps:

calculating the first average color saturation signal corresponding to the first color space signals by using a formula Sn_ave=Average(Sn_1,1, Sn_1,2, . . . , Sn_i,j);

calculating the second average color saturation signal corresponding to the second color space signals by using a formula S' n_ave=Average(S' n_1,1, S' n_1,2, . . . , S' n_i,j); and obtaining the light source adjustment coefficient by calculating the first average color saturation signal Sn_ave and the second average color saturation signal S' n_ave.

7. The driving method of the display module according to claim 6, wherein the step of obtaining the light source adjustment coefficient by calculating the first average color saturation signal and the second average color saturation signal comprises steps:

calculating the first average color saturation signal by using a formula Sn_ave=1−minn_ave/maxn_ave; and calculating the second average color saturation signal by using a formula S' n_ave=I-min' n_ave/max' n_ave;

obtaining a third average color saturation signal S"n_ave according to the light source adjustment coefficient and the second average color saturation signal;

wherein max' n_ave=maxn_ave, and the light source adjustment coefficient y satisfies following formulas:

$$S''n_ave=Sn_ave;$$

$$1-minn_ave/maxn_ave=1-min'n_ave/(max'n_ave*y);\ \text{and}$$

$$y=(S'n_ave-1)/(Sn_ave-1);$$

wherein maxn_ave is the maximum average signal among the red sub-pixel average signal, the green sub-pixel average signal, and the blue sub-pixel average signal of the first color signals of all pixels in the current backlight partitions corresponding to the current frame, and minn_ave is the minimum average signal among the red sub-pixel average signal, the green sub-pixel average signal, and the blue sub-pixel average signal of the first color signals of all pixels in the current backlight partitions corresponding to the current frame:

wherein max' n_ave is the maximum average signal among a red sub-pixel average signal, a green sub-pixel average signal, and a blue sub-pixel average signal of the second color signals of all pixels in the current backlight partitions corresponding to the current frame, and min' n_ave is the minimum average signal among the red sub-pixel average signal, the green sub-pixel average signal, and the blue sub-pixel average signal of the second color signals of all pixels in the current backlight partitions corresponding to the current frame.

8. The driving method of the display module according to claim 1, wherein the step of adjusting the color saturation of the first color space signals by the predetermined adjustment coefficients to obtain the second color space signals in the HSV system comprises steps:

obtaining current color saturation signals of the first color space signals, detecting whether the current color saturation signals satisfy a predetermined color saturation threshold, and detecting whether the current color saturation signals are in an adjusted hue interval, and if yes, obtaining corresponding predetermined adjustment coefficients according to the corresponding color saturation values and corresponding hue intervals based on the color saturation signals; and adjusting the current color saturation signals to obtain the second color space signals in the HSV system by the predetermined adjustment coefficients.

9. The driving method of the display module according to claim 8, wherein the predetermined adjustment coefficients are calculated by calculating the color saturation signals according to a predetermined calculation formula or by looking up in a predetermined adjustment coefficient look up table.

10. The driving method of the display module according to claim 9, wherein the adjustment coefficient look up table is a look up table directly recorded with predetermined adjustment coefficients, or is a look up table recording a predetermined calculation formula.

11. The driving method of the display module according to claim 10, wherein the second color space signals and the first color space signals conform to a following formula:

$$S'=a*S4+b*S3+c*S2+d*S+e;$$

wherein S is the current color saturation signals corresponding to the first color space signals, and S' is the color saturation signals corresponding to the second color space signals; the a, b, c, d, e are constants, the a, b, c, d, e are obtained by looking up in a predetermined formula coefficient look up table according to different color saturation values and different hue intervals.

12. The driving method of the display module according to claim 8, wherein in the step of obtaining the predetermined adjustment coefficients corresponding to the current color saturation signals, when corresponding to a same hue, greater the color saturation values of the current color saturation signals, greater an adjustment amplitude of an adjustment process is.

13. The driving method of the display module according to claim 12, wherein the color saturation signals are split into at least a first hue interval, a second hue interval, and a third hue interval according to different hues;

wherein the first hue interval, the second hue interval, and the third hue interval are defined as a red hue interval, a green hue interval, and a blue hue interval respectively;

wherein in the current color saturation signals having a same color saturation value, the adjustment amplitude of the predetermined color adjustment signals corresponding to the blue hue interval to the current color saturation signals is greater than the adjustment amplitude of the predetermined color adjustment signals corresponding to the red hue interval to the current color saturation signals; the adjustment amplitude of the predetermined color adjustment signals corresponding to the red hue interval to the current color saturation signals is greater than the adjustment amplitude of the predetermined color adjustment signals corresponding to the green hue interval to the current color saturation signals.

14. The driving method of the display module according to claim 13, wherein a hue value ranges from 0-360, corresponding to 0-360 degrees;

wherein the hue value of a hue interval satisfying a following formula is the red hue interval: $0 \leq Hue < 40$, or $320 < Hue \leq 360$;

wherein the hue value of the hue interval satisfying a following formula is the green hue interval: $80 < Hue < 160$;

wherein the hue value of the hue interval satisfying a following formula is the blue hue interval: $40 \leq Hue \leq 80$, or $160 \leq Hue \leq 200$;

wherein the hue value of the hue interval satisfying the following formula is an unadjusted hue interval: $40 \leq Hue \leq 80$, or $160 \leq Hue \leq 200$, or $280 \leq Hue \leq 320$.

15. The driving method of the display module according to claim 1, wherein the step of adjusting the color saturation of the first color space signals by the predetermined adjustment coefficients to obtain the second color space signals in the HSV system comprises steps:

obtaining current color saturation signals of the first color space signals, detecting whether the current color saturation signals satisfy a predetermined color saturation threshold, and detecting whether they are in an adjusted hue interval, and if yes, obtaining corresponding predetermined adjustment coefficients according to the corresponding color saturation values and corresponding hue interval based on the color saturation signals; and adjusting the current color saturation signals to obtain second color space signals in the HSV system by the predetermined adjustment coefficients;

wherein the predetermined adjustment coefficients are calculated by calculating color saturation signals according to a predetermined calculation formula or by looking up in a predetermined adjustment coefficient look up table.

16. The driving method of the display module according to claim 15, wherein the color saturation threshold is 0.5, and if the color saturation values of the current color saturation signals are greater than 0.5, the color saturation values of the current color saturation signals satisfy the color saturation threshold.

17. The driving method of the display module according to claim 15, wherein the color saturation threshold is more than 0.5 and less than 1.

18. A driving system of a display module: comprising a display panel driving circuit, and a backlight module driving circuit driven synchronously with the display panel driving circuit;

wherein the display module comprises a plurality of first color light sources and second color light sources, the first color light sources and the second color light sources are controlled independently;

wherein the display panel driving circuit comprises a receiving circuit, a color saturation adjustment circuit, and a first driving circuit;

wherein the receiving circuit receives first color signals in an RGB system corresponding to a display panel and converts the first color signals into first color space signals in an HSV system;

the color saturation adjustment circuit adjusts a color saturation of the first color space signals by predetermined adjustment coefficients to obtain second color space signals in the HSV system; and converts the second color space signals into second color signals in the RGB system; and the first driving circuit drives the display panel by the second color signals;

wherein the backlight module driving circuit comprises a light source adjustment calculation circuit, a light source adjustment circuit, a dominant hue light source calculation circuit, and a second driving circuit;

wherein the light source adjustment calculation circuit receives the first color signals in the RGB system corresponding to the display panel, obtains the first color space signals in the HSV system and the second color space signals in the HSV system, and obtains a light source adjustment coefficient according to the first color space signals and the second color space signals, the light source adjustment circuit adjusts a first brightness value corresponding to the first color light source and/or the second color light source by the light source adjustment coefficient to obtain a second brightness value; the dominant hue light source calculation circuit determines a dominant hue light source from the first color light sources and the second color light sources; and the second driving circuit drives the dominant hue light source by the second brightness value.

19. A display device, comprising a driving system of a display module; wherein the driving system comprises:

a display panel driving circuit, and a backlight module driving circuit driven synchronously with the display panel driving circuit;

wherein the display module comprises a plurality of first color light sources and second color light sources, the first color light sources and the second color light sources are controlled independently;

wherein the display panel driving circuit comprises a receiving circuit, a color saturation adjustment circuit, and a first driving circuit;

wherein the receiving circuit receives first color signals in an RGB system corresponding to a display panel and converts the first color signals into first color space signals in an HSV system; the color saturation adjustment circuit adjusts a color saturation of the first color space signals by predetermined adjustment coefficients to obtain second color space signals in the HSV system; and converts the second color space signals into second color signals in the RGB system; and the first driving circuit drives the display panel by the second color signals;

wherein the backlight module driving circuit comprises a light source adjustment calculation circuit, a light source adjustment circuit, a dominant hue light source calculation circuit, and a second driving circuit;

wherein the light source adjustment calculation circuit receives the first color signals in the RGB system corresponding to the display panel, obtains the first color space signals in the HSV system and the second color space signals in the HSV system, and obtains a light source adjustment coefficient according to the first color space signals and the second color space signals, the light source adjustment circuit adjusts a first brightness value corresponding to the first color light source and/or the second color light source by the light source adjustment coefficient to obtain a second brightness value; the dominant hue light source calculation circuit determines a dominant hue light source from the first color light sources and the second color light sources; and the second driving circuit drives the dominant hue light source by the second brightness value.

* * * * *